US009326657B2

(12) United States Patent
Thiyagarajan

(10) Patent No.: US 9,326,657 B2
(45) Date of Patent: May 3, 2016

(54) DUAL DIRECTION, DOUBLE TIER SPRAY ARM ASSEMBLY FOR A DISHWASHING APPLIANCE

(75) Inventor: Ramasamy Thiyagarajan, Louisville, KY (US)

(73) Assignee: General Electric Company, Schenectady, NY (US)

( * ) Notice: Subject to any disclaimer, the term of this patent is extended or adjusted under 35 U.S.C. 154(b) by 1118 days.

(21) Appl. No.: 13/238,696

(22) Filed: Sep. 21, 2011

(65) Prior Publication Data

US 2013/0068259 A1 Mar. 21, 2013

(51) Int. Cl.
*A47L 15/23* (2006.01)
*A47L 15/42* (2006.01)

(52) U.S. Cl.
CPC ..... *A47L 15/23* (2013.01); *A47L 15/428* (2013.01); *A47L 15/4278* (2013.01)

(58) Field of Classification Search
None
See application file for complete search history.

(56) References Cited

U.S. PATENT DOCUMENTS 2,664,903 A 1/1954 Sway
5,477,874 A * 12/1995 Yura et al. ..... 134/176
6,641,058 B2 11/2003 Hegeman et al.
2007/0295361 A1 12/2007 Thiyagarajan et al.
2010/0139698 A1 6/2010 Gnadinger et al.
2010/0139719 A1 6/2010 Gnadinger et al.

FOREIGN PATENT DOCUMENTS

EP 1 010 390 6/2000
JP 4-166124 6/1992
JP 2932272 8/1999
JP 2002136941 5/2002
KR 10-2008-0046850 * 5/2008

OTHER PUBLICATIONS

Machine Translation of KR10-2008-0046850 by Ryu Jung-Chan, published May 28, 2008.*

* cited by examiner

*Primary Examiner* — Michael Kornakov
*Assistant Examiner* — Ryan Coleman
(74) *Attorney, Agent, or Firm* — Dority & Manning, P.A.

(57) ABSTRACT

A spray arm assembly for a dishwashing appliance is provided. The assembly can provide for sprays of fluid at different angles against the articles to be cleaned. For example, the spray arm assembly can have at least two spray bodies rotatable in opposite directions. Because the fluid is sprayed from the spray bodies at different angles and from different directions, more efficient and effective cleaning can be accomplished. In certain embodiments of the invention, one or both spray bodies may be operated at any one time and/or at different flow rates.

13 Claims, 5 Drawing Sheets

DUAL DIRECTION, DOUBLE TIER SPRAY ARM ASSEMBLY FOR A DISHWASHING APPLIANCE

FIELD OF THE INVENTION

The subject matter of the present invention relates to a dishwashing appliance and, more particularly, to a spray arm assembly for a dishwashing appliance that has two spray bodies rotatable in opposite directions.

BACKGROUND OF THE INVENTION

Modern dishwashers typically include a wash chamber where e.g., detergent, water, and heat can be applied to clean food or other materials from dishes and other articles being washed. Often an upper rack assembly is disposed close to the top of the washing chamber and is used to hold glasses, cups, and other small items. Typically, a lower rack assembly is positioned near the bottom of the chamber and a considerable distance below the upper rack. This provides vertical clearance to place dishes and platters on edge (i.e. a vertical orientation) and to place food preparation bowls and pots upside-down on the lower rack for washing.

Each rack normally is supplied with an array of spaced apart, generally vertical tines or members, which support and separate the individual items. Preferably, these vertical members support and fix the position of various articles during the washing process. More specifically, it is desirable to position an article, such as a dish, so that water and detergent can access all surfaces during cleaning while also preventing movement of the dish that could lead to breaking, chipping, or other damage.

Conventionally, water containing detergent, rinse water, and/or other fluids is sprayed onto the dishes by rotating spray arm assemblies—one positioned below the upper rack and one below the lower rack. Water is fed to the spray arm assemblies from the rear of the dishwasher. Each spray arm assembly is typically equipped with one more holes for the release of a pressurized fluid to wash or rinse the articles. Each spray arm assembly rotates in only one direction, a rotation caused by the flow of water exiting the arms because the holes are typically oriented at an angle. As this angle is fixed, each spray arm can only rotate in one direction. As such, the angle at which fluids are applied against articles in the racks typically remains constant. For example, the interior of a cup, pot, or other container turned over in the upper rack will likely receive an intermittent spray that is only provided at the same angle with each rotation of the spray arm assembly. Depending on the amount and placement of soiling along the interior of the container, this conventional spray configuration can lead to incomplete and/or inefficient cleaning of the article. Increasing the wash cycle time may provide improved performance but at additional costs in operating the appliance.

Accordingly, an apparatus that can provide improved cleaning capability for a dishwasher would be useful. More particularly, such an apparatus that can provide sprays of fluid from multiple different angles, particularly against e.g., the interior of various containers, would be beneficial. Such an apparatus that can also be operated in different modes to e.g., provide spraying from different directions at the same or different times would also be very useful.

BRIEF DESCRIPTION OF THE INVENTION

Aspects and advantages of the invention will be set forth in part in the following description, or may be obvious from the description, or may be learned through practice of the invention.

In one exemplary embodiment, the present invention provides a spray arm assembly for a dishwashing appliance. The spray arm assembly includes a first spray body having two arms and a first plurality of orifices located along only one of the two arms of the first spray body. The first plurality of orifices are oriented so as to cause a clockwise rotation of the first spray body. A second spray body having two arms and a second plurality of orifices is located along only one of the two arms of the second spray body. The second plurality of orifices are oriented so as to cause a counter clockwise rotation of the second spray body.

In another exemplary embodiment, the present invention provides a dishwashing appliance. The appliance includes a cabinet defining a wash chamber for the receipt of articles for washing and a pump configured for the receipt of a fluid to be recirculated into the wash chamber of the cabinet. The pump has an inlet. A first spray body is provided having two arms wherein only one of the two arms defines a first plurality of orifices. The first plurality of orifices are oriented so as to cause a rotation of the first spray body along a first direction. A second spray body is provided having two arms wherein only one of the two arms defines a second plurality of orifices. The second plurality of orifices are oriented so as to cause a rotation of the second spray body along a second direction that is opposite to the first direction. The second spray body is connected with the first spray body and is positioned adjacent to the first spray body.

In another exemplary aspect of the present invention, a method of operating a spray arm assembly of a dishwashing appliance is provided. The spray arm assembly has a first spray body and a second spray body connected with each other and located adjacent to one another. Each spray body has a plurality of orifices for the release of a fluid. The method includes the steps of rotating the first spray body in a first direction; and counter rotating the second spray body in a second direction that is opposite to the first direction; wherein the rotating and counter rotating steps are executed either simultaneously or at different times.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
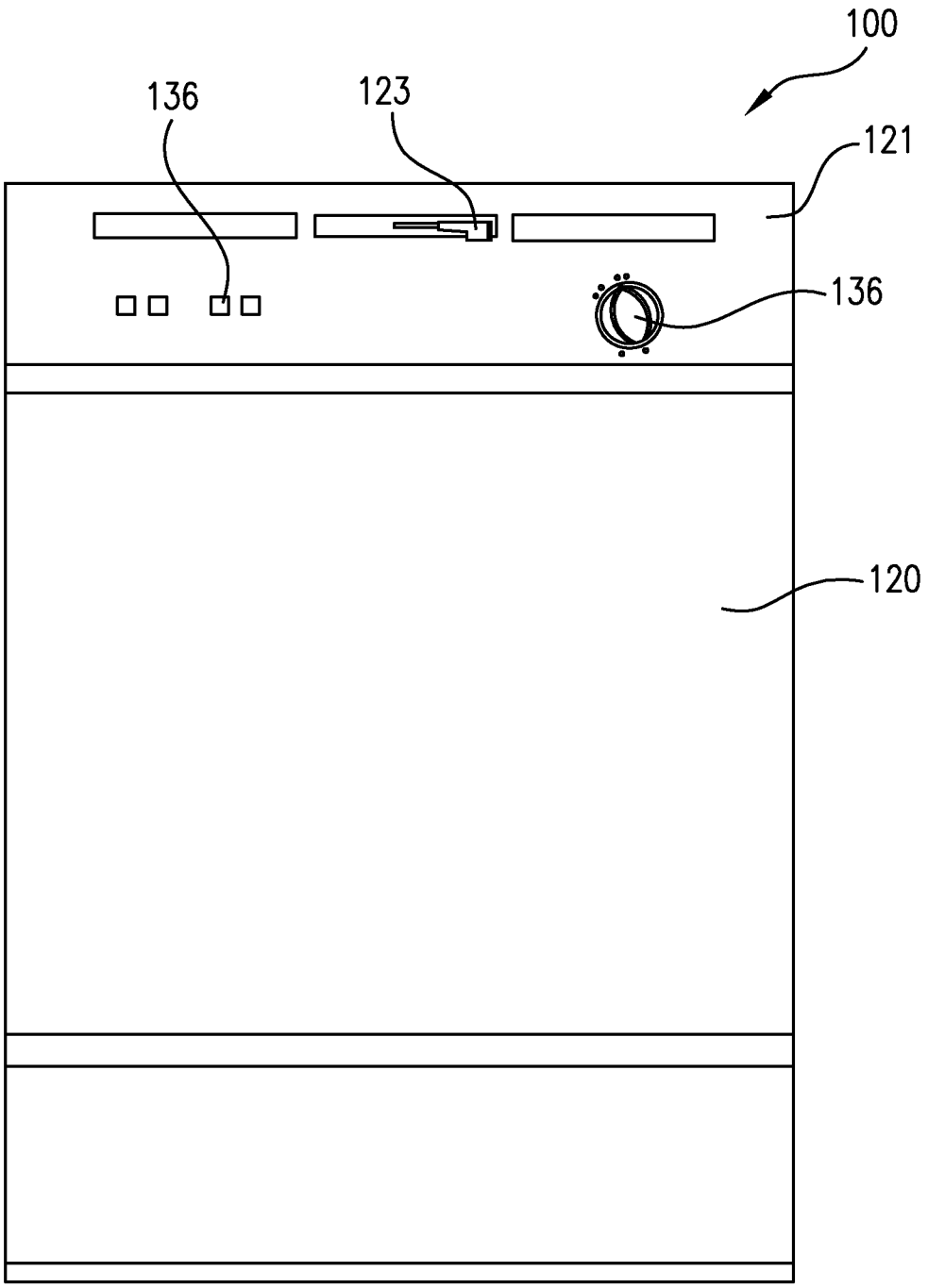
FIG. 1 provides a front, perspective view of an exemplary dishwashing appliance of the present invention.

The present invention provides a spray arm assembly for a dishwashing appliance that can provide for sprays of fluid at different angles against the articles to be cleaned. More specifically, a spray arm assembly is provided that has at least two spray bodies rotatable in opposite directions. Because the fluid is sprayed from the spray bodies at different angles and from different directions, more efficient and effective cleaning can be accomplished. Additionally, in certain embodiments of the invention, one or both spray bodies may be operated at any one time and/or at different flow rates. Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
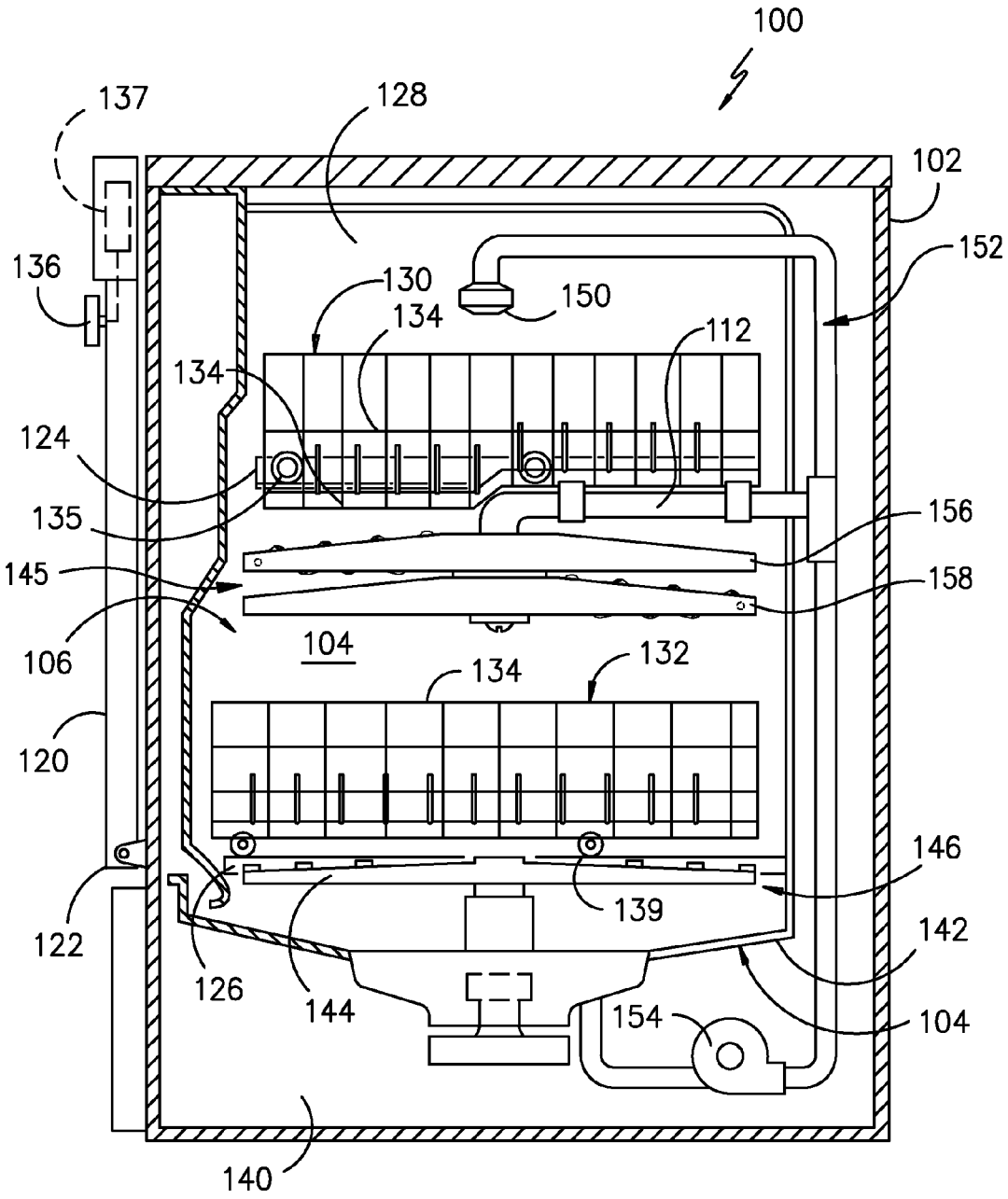
FIG. 2 provides a side, cross-sectional view of the exemplary appliance of FIG. 1.

FIGS. 1 and 2 depict an exemplary domestic dishwasher 100 that may be configured in accordance with aspects of the present disclosure. For the particular embodiment of FIG. 1, the dishwasher 100 includes a cabinet 102 having a tub 104 therein that defines a wash chamber 106. The tub 104 includes a front opening (not shown) and a door 120 hinged at its bottom 122 for movement between a normally closed vertical position (shown in FIGS. 1 and 2), wherein the wash chamber 106 is sealed shut for washing operation, and a horizontal open position for loading and unloading of articles from the dishwasher. Latch 123 is used to lock and unlock door 120 for access to chamber 106.

Upper and lower guide rails 124, 126 are mounted on tub side walls 128 and accommodate roller-equipped rack assemblies 130 and 132. Each of the rack assemblies 130, 132 is fabricated into lattice structures including a plurality of elongated members 134 (for clarity of illustration, not all elongated members making up assemblies 130 and 132 are shown in FIG. 2). Each rack 130, 132 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by rollers 135 and 139, for example, mounted onto racks 130 and 132, respectively. A silverware basket (not shown) may be removably attached to rack assembly 132 for placement of silverware, utensils, and the like, that are otherwise too small to be accommodated by the racks 130, 132.

The dishwasher 100 further includes a lower spray-arm assembly 144 that is rotatably mounted within a lower region 146 of the wash chamber 106 and above a tub sump portion 142 so as to rotate in relatively close proximity to rack assembly 132. A mid-level spray-arm assembly 145 is located in an upper region of the wash chamber 106 and may be located in close proximity to upper rack 130. Additionally, an upper spray assembly 150 may be located above the upper rack 130.

The lower and mid-level spray-arm assemblies 144, 145 and the upper spray assembly 150 are fed by a fluid circulation assembly 152 for circulating water and dishwasher fluid in the tub 104. The fluid circulation assembly 152 may include a pump 154 located in a machinery compartment 140 located below the bottom sump portion 142 of the tub 104, as generally recognized in the art. Each spray-arm assembly 144, 145 includes an arrangement of discharge ports or orifices for directing washing liquid onto dishes or other articles located in rack assemblies 130 and 132 as will be further described. The arrangement of the discharge ports in spray-arm assemblies 144, 145 provides a rotational force by virtue of fluid flowing through the discharge ports. The resultant rotation of the spray-arm assemblies 144, 145 enhances the coverage of dishes and other dishwasher contents with a wash or rinse spray.

The dishwasher 100 is further equipped with a controller 137 to regulate operation of the dishwasher 100. The controller may include a memory and one or more microprocessors, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher 100. In the illustrated embodiment, the controller 137 may be located within a control panel area 121 of door 120 as shown. In such an embodiment, input/output ("I/O") signals may be routed between the control system and various operational components of dishwasher 100 along wiring harnesses that may be routed through the bottom 122 of door 120. Typically, the controller 137 includes a user interface panel 136 through which a user may select various operational features and modes and monitor progress of the dishwasher 100. In one embodiment, the user interface 136 may represent a general purpose I/O ("GPIO") device or functional block. In one embodiment, the user interface 136 may include input components, such as one or more of a variety of electrical, mechanical or electromechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

Figure 3:
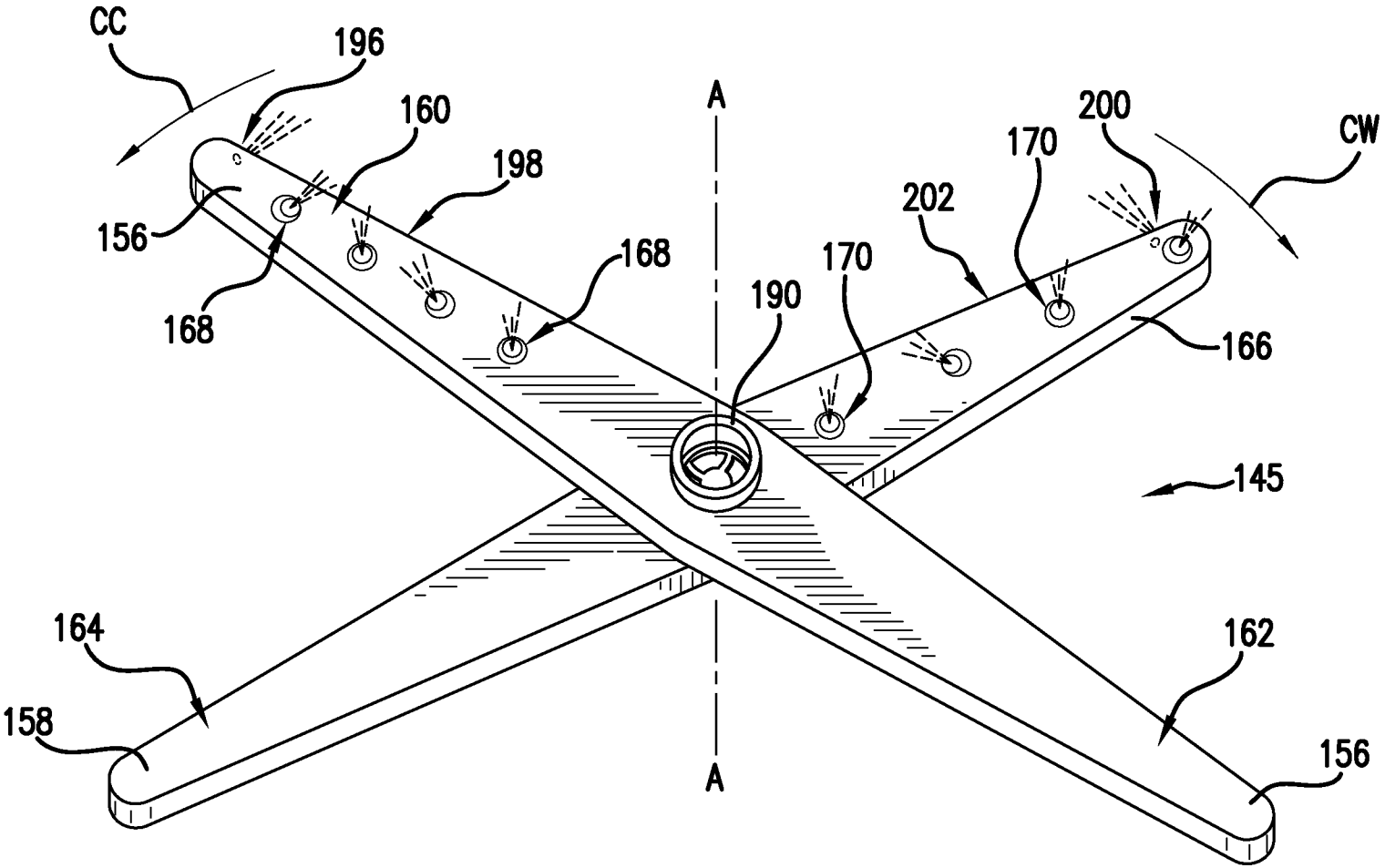
FIG. 3 is a perspective view of an exemplary embodiment of a spray arm assembly of the present invention.
Figure 4:
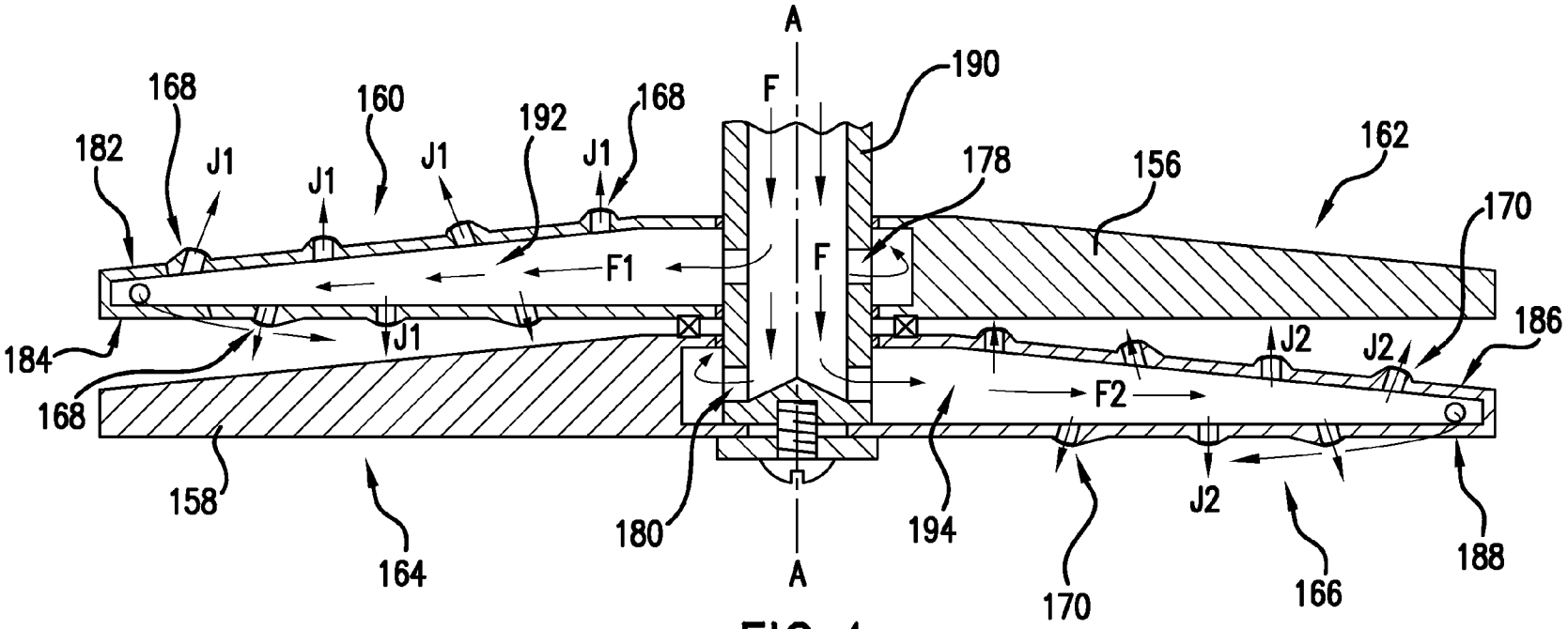
FIG. 4 is a cross-sectional view of the exemplary embodiment of a spray arm assembly shown in FIG. 3.

FIG. 3 provides a perspective view of an exemplary embodiment of a spray arm assembly 145 as may be used with the present invention, and FIG. 4 provides a cross-sectional view thereof. Although shown as the mid-level spray arm assembly 145 in FIG. 2, spray arm assembly 145 may be used in other locations in dishwashing appliance 100 as well. For example, spray arm assembly 145 may also be used in place of lower spray arm assembly 144. Other configurations may also be applied.

Continuing with FIGS. 3 and 4, spray arm assembly 145 includes a first spray body 156 that has two arms, 160 and 162. Arms 160 and 162 are located on opposing sides of first spray body 156 and, together, rotate about axis A-A in a counter-clockwise direction as shown by arrow CC. During a wash cycle or rinse cycle, fluid is provided through fluid circulation assembly 152 through pressure provided by pump 154. As shown by arrows F, such fluid travels through fluid supply conduit 190 and enters first spray body 145 through one or more orifices 178. The fluid then travels through a first internal cavity 192 defined by first spray body 156 as indicated by arrows F1. Upon reaching a first plurality of orifices 168, the fluid is sprayed or ejected as various jets J1. One or more of the orifices 168 is oriented (i.e. angled) so that the action-reaction forces cause by jets J1 imparts rotation to first spray body 156 along direction CC. For this exemplary embodiment, the first plurality of orifices 168 is positioned only along one side of first spray body 156—i.e. only along arm 160. Accordingly, first internal cavity 192 is defined only within arm 160. As will be understood by one of skill in the art using the teachings disclosed herein, orifices could be positioned along both arms 160 and 162—provided the orifices are oriented to provide rotation in the desired direction. In addition, for this exemplary embodiment, orifices 168 are shown on both top surface 182 and bottom surface 184. However, orifices 168 can also be located only upon either one of surfaces 182 and 184 as well. One or more orifices 196 can also be located along side surface 198.

Similarly, spray arm assembly 145 also includes a second spray body 158 that has two arms, 164 and 166. Arms 164 and 166 are located on opposing sides of second spray body 158 and, together, rotate about axis A-A in a clockwise direction as shown by arrow CW. As shown in FIGS. 3 and 4, second spray body 158 is positioned adjacent to first spray body 156 and, for the exemplary embodiment, is connected to first spray body 156 through by fluid supply conduit 190.

During a wash cycle or rinse cycle, fluid is provided through fluid circulation assembly 152 through pressure provided by pump 154. As shown by arrows F, such fluid travels through fluid supply conduit 190 and enters second spray body 158 through one or more orifices 180. The fluid then travels through a second internal cavity 194 defined by second spray body 158 as indicated by arrows F2. Upon reaching a second plurality of orifices 170, the fluid is sprayed or ejected as various jets J2. One or more of the orifices 170 is oriented (i.e. angled) so that the action-reaction forces cause by jets J2 imparts rotation to second spray body 158 along direction CW. For this exemplary embodiment, the second plurality of orifices 170 is positioned only along one side of second spray body 158—i.e. only along arm 166. Accordingly, second internal cavity 194 is defined only within arm 166. As will be understood by one of skill in the art using the teachings disclosed herein, orifices could be positioned along both arms 164 and 166—provided the orifices are oriented to provide rotation in the desired direction. In addition, for this exemplary embodiment, orifices 170 are shown on both top surface 186 and bottom surface 188 (FIG. 4). However, orifices 170 can also be located only upon either one of surfaces 186 and 188 as well. One or more orifices 200 can also be located along side surface 202. Also, the orifices for the first and/or second spray body 156 and 158 may be configured to provide different spray types. For example, one or more of the orifices may be configured to generate a pencil jet, fan jet, or combinations thereof when a fluid is distributed therefrom. Other configurations may be used as well.

Although first spray body 156 is shown with a counterclockwise rotation (arrow CC), while second spray body 158 is shown with a clockwise rotation. Such selection is used purely by way of example, it being understood that the direction or rotation for each body could be reversed through the appropriate orientation of orifices 168 and 170. Regardless, first spray body 156 is configured to rotate in one direction while second spray body 158 is configured to operate in an opposite direction.

Additionally, it should be understood that first spray body 156 and second spray body 158 can rotate at the same time or can be operated separately at different times. For example, through the use of one or more pumps and/or valving arrangements, the rotation of spray bodies 156 and 158 can be executed at different times or simultaneously. In addition, by controlling the flow rate F1 and/or F2 using e.g., valving or variations in pump speed, the speed or rotation of one or both spray bodies 156 and 158 may be controlled.

Figure 5:
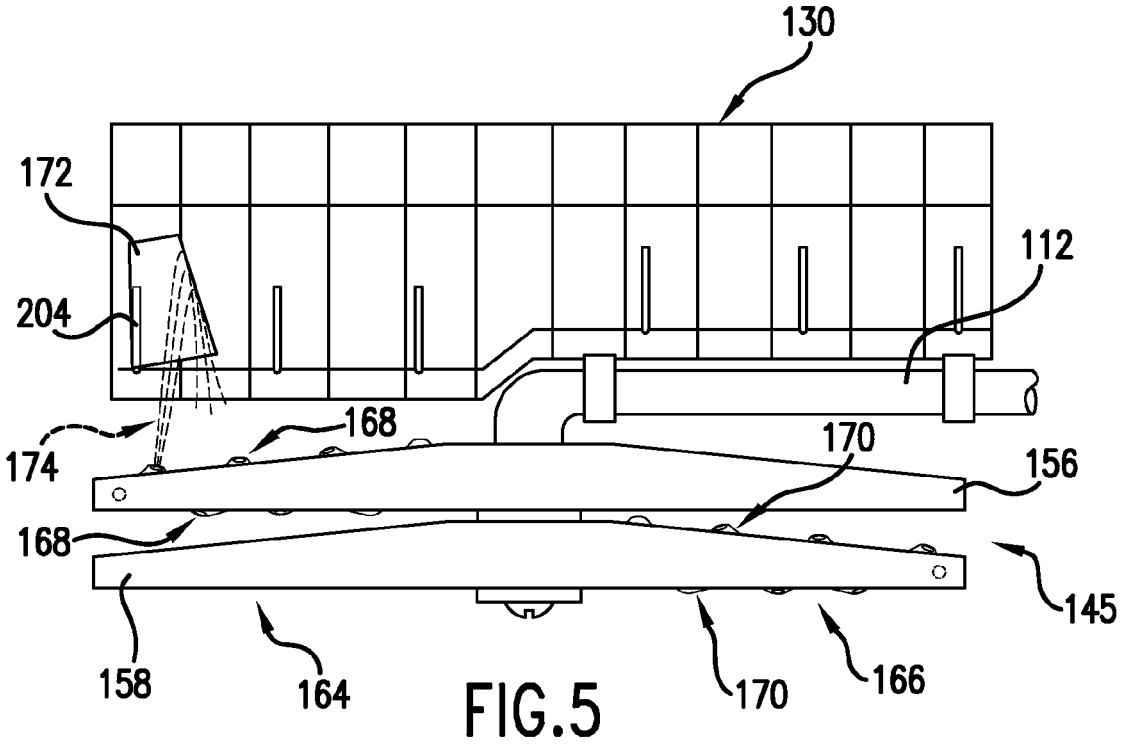
FIGS. 5 and 6 depicts operation of a spray arm assembly attached to the bottom of an upper rack of a dishwashing appliance. The present invention also provides for e.g., a spray arm assembly located below the lower rack of the appliance.
Figure 6:
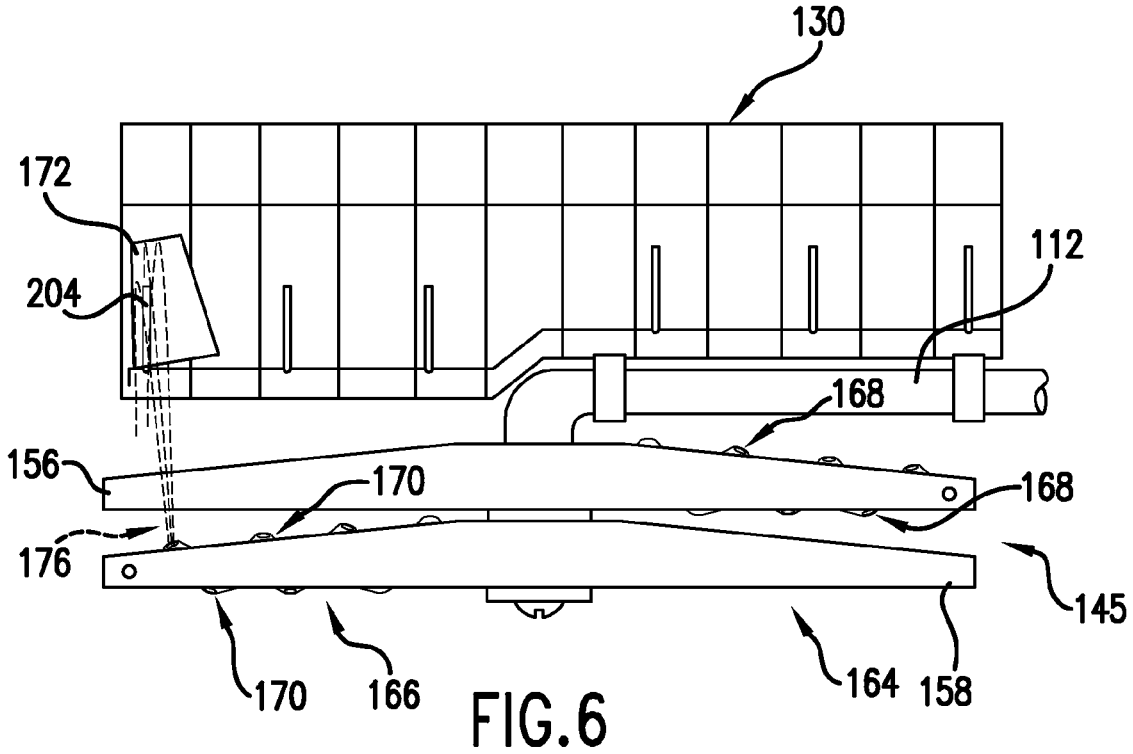

FIGS. 5 and 6 show one of the beneficial aspects of spray arm assembly 145. Upper rack 130 includes a cup 172 positioned on one of the tines 204. During operation of appliance 100 as shown in FIG. 5, first spray body 156 provides a jet 174 of fluid during either a wash cycle or rinse cycle that impacts cup 172 along one side due to the angle of jet 174 provided by orifice 168. Similarly, during a wash cycle or rinse cycle, second spray body 158 provides a jet 176 of fluid that also impacts cup 172 as shown in FIG. 6. However, because second spray body 158 is rotating in a different direction from first spray body 156 due to orifices 170 that are oriented a different angle than orifices 168, jet 176 impacts a different side of the interior of cup 172. Accordingly, the cleaning of cup 172 can be improved over conventional appliances because more surfaces of cup 172 are impacted. In addition, such cleaning can be more efficient because a conventional, single spray body operating in only one direction may have to be operated for a longer cycle time in order to wash and/or rinse the interior of cup 172.

The shape, locations of orifices, and aesthetic aspects of spray bodies 156 and 158 are provided by way of example only. Other shapes and configurations may be used to provide still more embodiments of a spray arm assembly of the present invention. Additionally, a different number of orifices may be used on each body 156 and 158 from what is shown.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A spray arm assembly for a dishwashing appliance, comprising:

a first spray body having a first arm and an opposing second arm, the first arm defining a first internal cavity and a first plurality of orifices in fluid communication with the cavity and oriented so as to cause a clockwise rotation of said first spray body, the second arm being orifice free; and a second spray body having a first arm and an opposing second arm, the first arm defining a second cavity and a second plurality of orifices oriented so as to cause a counterclockwise rotation of said second spray body, the second arm being orifice free;

wherein said first spray body and said second spray body are connected in fluid communication through a single fluid communication conduit and rotate only concentric with each other.

2. A spray arm assembly for a dishwashing appliance as in claim 1, wherein said first spray body is positioned adjacent to said second spray body.

3. A spray arm assembly for a dishwashing appliance as in claim 1, wherein the single fluid communication conduit is a centrally-located fluid supply conduit; and wherein said first spray body and said second spray body are rotatably connected to said fluid supply conduit.

4. A spray arm assembly for a dishwashing appliance as in claim 1, wherein at least one of said first spray body or said second spray body has at least one orifice that is configured to generate a pencil jet, fan jet, or combinations thereof when a fluid is distributed therefrom.

5. A spray arm assembly for a dishwashing appliance as in claim 1, wherein the spray arm assembly is attached to an upper rack of the dishwashing appliance.

6. A spray arm assembly for a dishwashing appliance as in claim 1, wherein said first plurality of orifices are located along both a top surface and a bottom surface of said first spray body.

7. A spray arm assembly for a dishwashing appliance as in claim 1, wherein said second plurality of orifices are located along both a top surface and a bottom surface of said second spray body.

8. A dishwashing appliance, comprising:

a cabinet defining a wash chamber for the receipt of articles for washing;

a pump configured for the receipt of a fluid to be recirculated into the wash chamber of said cabinet, said pump having an inlet;

a first spray body having a first arm and an opposing second arm, the first arm defining a first internal cavity and a first plurality of orifices in fluid communication with the cavity and oriented so as to cause a rotation of said first spray body along a first direction, the second arm being orifice free; and a second spray body having a first arm and an opposing second arm, the first arm defining a second internal cavity and a second plurality of orifices oriented so as to cause a rotation of said second spray body along a second direction that is opposite to said first direction, and the second arm being orifice free, wherein said second spray body is connected with said first spray body and is positioned adjacent to said first spray body;

wherein said first spray body and said second spray body are connected in fluid communication through a single fluid communication conduit and rotate only concentric with each other.

9. A dishwashing appliance as in claim 8, wherein said first plurality of orifices are located along both a top surface and a bottom surface of said first spray body.

10. A dishwashing appliance as in claim 9, wherein said second plurality of orifices are located along both a top surface and a bottom surface of said second spray body.

11. A dishwashing appliance as in claim 8, wherein at least one of said first plurality of orifices or said second plurality of orifices has at least one orifice that is configured to generate a pencil jet, fan jet, or combinations thereof when a fluid is distributed therefrom.

12. A dishwashing appliance as in claim 8, wherein said first spray body and said second spray body are suspended below an upper rack of the dishwashing appliance.

13. A dishwashing appliance, comprising:

a cabinet defining a wash chamber for the receipt of articles for washing;

a pump configured for the receipt of a fluid to be recirculated into the wash chamber of said cabinet, said pump having an inlet;

an upper rack slidably disposed within an upper portion of the cabinet;

a lower rack slidably disposed within a lower portion of the cabinet; and a mid-level spray arm assembly attached to the upper rack at a position between the upper rack and the lower rack, the mid-level spray arm assembly including a first spray body having a first arm and an opposing second arm, the first arm having a side surface extending between a top surface and a bottom surface, the first spray arm defining a first internal cavity, the top surface and the bottom surface each defining a plurality of orifices in fluid communication with the cavity, the side surface defining at least one orifice oriented so as to cause a rotation of said first spray body along a first direction, the second arm being orifice free, and a second spray body having a first arm and an opposing second arm, the first arm having a side surface extending between a top surface and a bottom surface, the first spray arm defining a first internal cavity, the top surface and the bottom surface each defining a plurality of orifices in fluid communication with the cavity, the side surface defining at least one orifice oriented so as to cause a rotation of said second spray body along a second direction that is opposite to said first direction, and the second arm being orifice free, where said second spray body is connected in fluid communication with said first spray body and is positioned adjacent to said first spray body;

wherein said first spray body and said second spray body are attached in fluid communication through a central fluid conduit.

* * * * *